US012734395B1

(12) United States Patent
Bolden

(10) Patent No.: US 12,734,395 B1
(45) Date of Patent: Sep. 15, 2026

(54) STRIKER VEST

(71) Applicant: Jon Hayes Bolden, Seattle, WA (US)

(72) Inventor: Jon Hayes Bolden, Seattle, WA (US)

( * ) Notice: Subject to any disclaimer, the term of this patent is extended or adjusted under 35 U.S.C. 154(b) by 115 days.

(21) Appl. No.: 18/773,439

(22) Filed: Jul. 15, 2024

Related U.S. Application Data

(60) Provisional application No. 63/527,020, filed on Jul. 15, 2023.

(51) Int. Cl.
*A63B 21/00* (2006.01)
*A63B 21/055* (2006.01)

(52) U.S. Cl.
CPC ..... *A63B 21/4007* (2015.10); *A63B 21/0557* (2013.01); *A63B 21/4021* (2015.10); *A63B 2214/00* (2020.08); *A63B 2244/102* (2013.01)

(58) Field of Classification Search
CPC ..... A63B 21/4007; A63B 21/0557; A63B 21/4021; A63B 2214/00; A63B 2244/102
See application file for complete search history.

(56) References Cited

U.S. PATENT DOCUMENTS 7,707,652 B2 * 5/2010 Senegal ..... A63B 23/047 2/102
2007/0015640 A1 * 1/2007 Demeniuk ..... A63B 21/00185 482/124
2007/0017001 A1 * 1/2007 Wagner ..... A41D 11/00 2/102
2007/0083975 A1 * 4/2007 Senegal ..... A63B 21/4017 2/102
2007/0135278 A1 * 6/2007 Grigoriev ..... A63B 21/0004 482/124
2007/0219074 A1 * 9/2007 Pride ..... A63B 21/154 482/121
2007/0289045 A1 * 12/2007 Evans ..... A45F 3/06 2/102

* cited by examiner

*Primary Examiner* — Andrew M Kobylarz
(74) *Attorney, Agent, or Firm* — MALLOY & MALLOY, P.L.

(57) ABSTRACT

The present invention is a training vest designed to enhance a fighter's combat skills by conditioning both the striking and guard arms simultaneously. The vest features a body with adjustable fastening means, such as Velcro straps, and multiple strategically positioned attachment points for resistance bands. It includes an adjustable cross strap, an upper forearm pull-in strap, and a lower stabilizer belt to ensure proper guard posture and stability during training. Resistance bands attach to wrist straps, providing customizable resistance levels for improved striking power, accuracy, and endurance. The dual-sided design allows for balanced training of both sides of the body. This training vest offers a comprehensive solution for combat training, promoting correct techniques and reducing injury risks.

17 Claims, 4 Drawing Sheets

STRIKER VEST

CLAIM OF PRIORITY

The present application is based on and a claim of priority is made under 35 U.S.C. Section 119(e) to a provisional patent application that is currently in the U.S. Patent and Trademark Office, namely, that having Ser. No. 63/527,020 and a filing date of Jul. 15, 2023, and which is incorporated herein by reference.

BACKGROUND OF THE INVENTION

Field of the Invention

The present invention relates to the field of combat training equipment. More specifically, it pertains to a vest designed to improve a fighter's striking posture, arm conditioning, and overall combat performance.

Description of the Related Art

In the realm of combat sports and training, maintaining an optimal striking posture and conditioning the arms are crucial for both offensive and defensive maneuvers. Traditional training methods often focus on isolated aspects of combat skills, such as striking accuracy, power, and defensive guard positioning. However, there is a persistent challenge in developing a training apparatus that holistically addresses these needs while being adaptable for various combat scenarios.

Various types of training equipment have been developed to enhance a fighter's performance. These range from simple resistance bands to complex weighted vests and harnesses. While these devices offer certain benefits, they frequently fall short in providing a comprehensive training solution. For instance, resistance bands can improve strength and flexibility, but they do not necessarily enforce proper guard posture. Weighted vests can increase endurance, but they might not effectively isolate and condition specific muscle groups crucial for striking. Therefore, there is a need for an innovative training device that integrates multiple functionalities to provide a balanced and effective combat training experience.

One of the significant problems faced by fighters is maintaining a proper guard while striking. A proper guard involves keeping the non-striking arm close to the body to protect against counterattacks, which requires continuous conditioning and muscle memory reinforcement.

Additionally, the striking arm must be trained to deliver powerful, accurate, and rapid punches without compromising the fighter's stance. Traditional training equipment does not adequately address the simultaneous conditioning of both the striking and guard arms, leading to suboptimal training outcomes.

Resistance bands, for example, are a common tool used to enhance arm strength and flexibility. They can be attached to various stationary objects to create resistance that the user must overcome, thereby building muscle strength and endurance. However, these bands do not address the need for maintaining a proper guard posture, as they do not simulate the dynamics of an actual combat scenario where one arm must remain close to the body to protect against strikes.

Weighted vests are another popular training tool. These vests are designed to add extra weight to the user's body, thereby increasing the intensity of physical exercises. While weighted vests can improve overall endurance and strength, they are not tailored to specifically enhance the striking and guard arms. The additional weight is distributed across the entire body, which does not isolate the muscles used for punching or for maintaining a guard posture. As a result, while the user may experience general physical improvements, the specific skills required for effective combat are not adequately targeted.

Another limitation of existing training equipment is the lack of adaptability. Fighters come in various sizes and have different training needs based on their combat styles and physical attributes. Training devices that do not allow for customization may not provide the optimal training experience for all users. For example, a tall fighter may require different resistance levels and angles compared to a shorter fighter. Therefore, a one-size-fits-all approach often fails to meet the diverse needs of fighters.

Additionally, traditional training methods and equipment often do not encourage fighters to develop an ambidextrous stance. An ambidextrous stance allows a fighter to switch between leading with the left or right arm, providing a tactical advantage in combat. However, most training devices are designed to enhance the dominant arm's performance, neglecting the development of the non-dominant arm. This oversight can limit a fighter's versatility and effectiveness in the ring.

Moreover, the integration of technology in training equipment has been limited. Advances in material science and biomechanics offer opportunities to create more effective and efficient training tools. For instance, using advanced materials that provide variable resistance levels can enhance training outcomes by simulating different combat scenarios. Similarly, incorporating biomechanical principles can ensure that the training device mimics the natural movements of the body, reducing the risk of injury and improving overall performance.

There is also a need for training equipment that can be easily used in various environments, from professional gyms to home settings. Equipment that is cumbersome or requires significant setup can deter consistent use, leading to less effective training. A practical training device should be easy to wear, adjust, and use, encouraging regular practice and improvement.

Lastly, the psychological aspect of training cannot be overlooked. Equipment that provides immediate feedback can help fighters understand their performance and make necessary adjustments in real-time. This immediate feedback can be crucial for developing proper techniques and habits. Devices that fail to offer such feedback may result in the reinforcement of improper techniques, ultimately hindering a fighter's progress.

In summary, while existing training equipment offers some benefits, there are numerous gaps that need to be addressed to provide a comprehensive training solution for combat sports. An ideal training apparatus should simultaneously condition the striking and guard arms, promote proper posture and stance, be adaptable to individual needs, and integrate advanced materials and biomechanics. Additionally, it should be easy to use and provide immediate feedback to enhance the training experience. The need for such an innovative and holistic training device is evident in the ongoing quest for improved combat training methodologies.

SUMMARY OF THE INVENTION

The present invention, referred to as the Striker Vest, is a dual-purpose training vest designed to enhance a fighter's combat skills by simultaneously conditioning both the striking and guard arms. The vest is equipped with multiple rings and straps that accommodate resistance bands and wrist straps, providing customizable resistance training to improve striking power, accuracy, and endurance. Additionally, the Striker Vest ensures proper guard posture by securing the non-striking arm close to the body, thereby reinforcing muscle memory and protective stance. The vest is designed to be easily adjustable, allowing fighters of various sizes to customize their training experience for optimal results.

The Striker Vest offers several advantages over traditional training equipment. Unlike resistance bands and weighted vests that address isolated aspects of combat training, the Striker Vest provides a comprehensive solution by conditioning both the striking and guard arms simultaneously. This integrated approach ensures that fighters maintain proper posture and stance while enhancing their punching power and accuracy. The vest's adjustable design accommodates fighters of different sizes and training needs, promoting a more personalized training experience. Furthermore, the incorporation of advanced materials and biomechanics principles reduces the risk of injury and enhances overall training effectiveness. By offering immediate feedback through its resistance mechanisms, the Striker Vest helps fighters develop correct techniques and habits, ultimately leading to improved performance in combat scenarios.

In a first implementation of the invention, the striker vest comprises a training vest designed to enhance a fighter's combat skills. The vest includes a body configured to be worn over the torso and secured with fastening means. It features a plurality of attachment points distributed across the vest body, allowing for the selective attachment of resistance bands. These resistance bands are further attached to the user's arm, providing resistance during training exercises. The vest is designed to facilitate the training of both sides of the user's body, with the attachment points strategically positioned to offer multiple configurations for various training exercises and user preferences.

In a second aspect, wherein the fastening means may comprise Velcro straps.

In another aspect, wherein the striker vest may further comprise at least one adjustable cross strap positioned to secure the user's non-striking arm close to the body, thereby maintaining proper guard posture.

In another aspect, wherein the cross strap may be configured to secure the elbow in a closed position against the body.

In another aspect, wherein the striker vest may further comprise an upper forearm pull-in strap comprising a circular loop placed around the user's upper forearm.

In another aspect, wherein the upper forearm pull-in strap may include at least two pull-in lever straps for securing the upper forearm and pulling it closer to the body.

In another aspect, the striker vest may further comprise a lower stabilizer belt configured to stabilize the vest during use.

In another aspect, wherein the lower stabilizer belt may be attached through loops on the lower back side of the vest body.

In another aspect, the striker vest may further comprise a wrist strap with an adjustable thumb loop for securing the user's wrist.

In another aspect, wherein the wrist strap may be configured to attach to a resistance band.

In another aspect, wherein the resistance band may adjustable to provide varying levels of resistance.

In another aspect, wherein the resistance band may be attached to the vest body at multiple attachment points.

In another aspect, wherein the vest body may be dual-sided to allow training of both sides of the user's body.

In another aspect, wherein the attachment points may be positioned to provide multiple configurations for different training exercises.

In another aspect, the striker vest may further comprise a plurality of rings distributed on the vest body for the attachment of resistance bands.

In another aspect, wherein the rings are positioned on the shoulders and sides of the vest body.

In another aspect, the striker vest may further comprise Velcro flaps on both sides of the vest body for securing the vest.

In another aspect, wherein the vest body may be made from a durable, lightweight material to ensure comfort and ease of movement during training.

In another implementation of the present invention, a method of using the striker vest for enhancing combat training involves the user first donning the vest by slipping it over their head and securing it snugly with the adjustable fastening means, such as Velcro straps. Once the vest is securely in place, the user selects the appropriate attachment points on the vest body for their desired training exercise. The resistance bands are then attached to the chosen rings and loops on the vest, and the other end of the bands is connected to the wrist straps, which are worn around the user's wrists. For enhanced guard posture, the adjustable cross strap is positioned to secure the non-striking arm close to the body. If further stabilization is needed, the lower stabilizer belt is threaded through the loops on the lower back side of the vest and fastened. The user can then proceed with their training regimen, performing striking exercises against the resistance provided by the bands, which helps improve striking power, accuracy, and endurance. The dual-sided design of the vest allows for balanced training of both sides of the body, and the various attachment points enable customization of resistance levels and training configurations to suit individual needs and preferences.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PREFERRED EMBODIMENT

Figure 1:
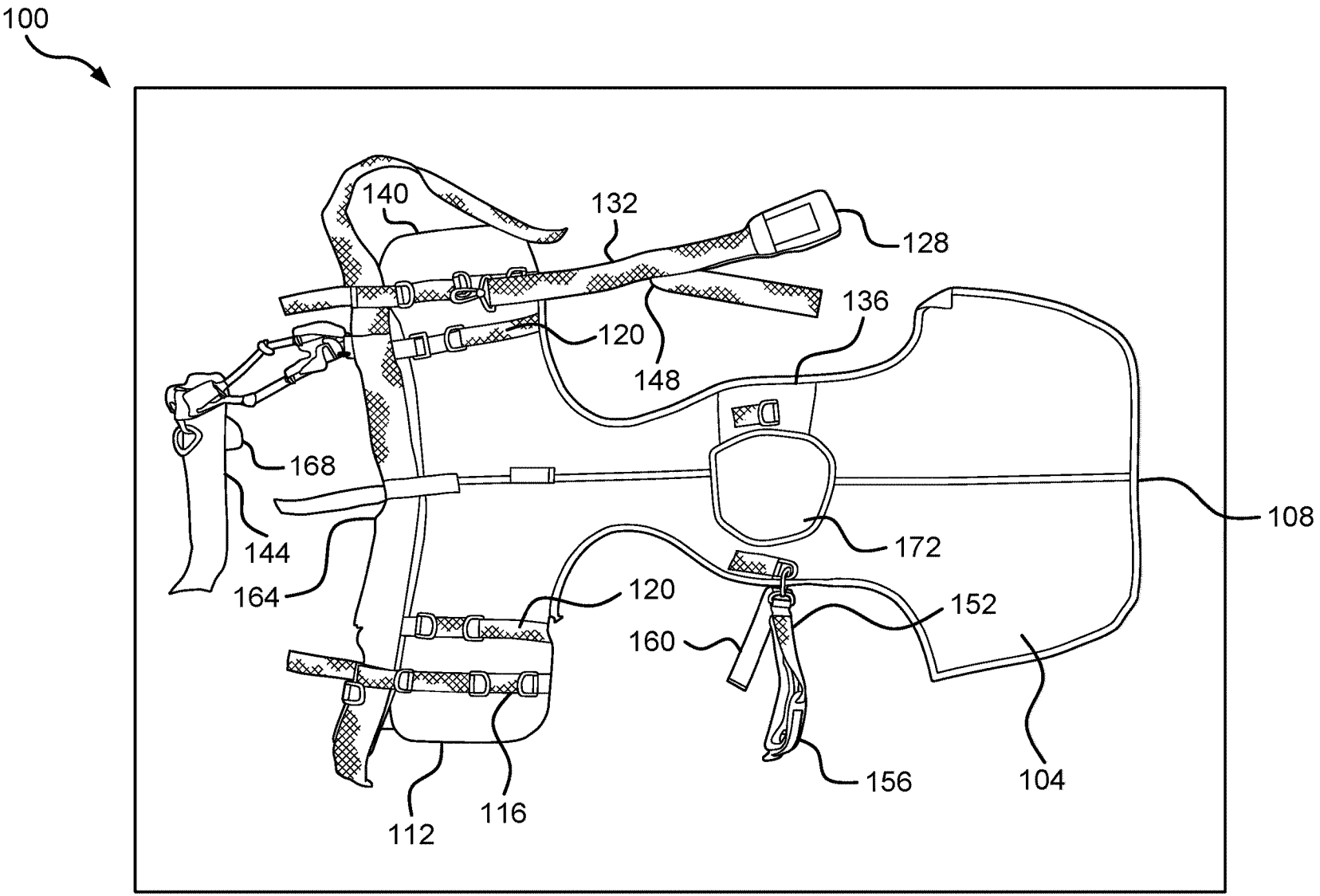
FIG. 1 presents a top view of the striker vest in an open configuration, illustrating various components including the vest body, the front side, the back side, the neck opening, the shoulder straps, the lower stabilizer belt, the upper forearm pull-in strap, and the cross strap.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As shown throughout the figures, the present invention, referred to as the Striker Vest 100, is designed to enhance a fighter's combat skills by simultaneously conditioning both the striking and guard arms. The vest is equipped with multiple rings and straps that accommodate resistance bands and wrist straps, providing customizable resistance training to improve striking power, accuracy, and endurance. Additionally, the Striker Vest 100 ensures proper guard posture by securing the non-striking arm close to the body, thereby reinforcing muscle memory and protective stance. The vest is designed to be easily adjustable, allowing fighters of various sizes to customize their training experience for optimal results.

The Striker Vest 100 comprises a vest body 104 configured to be worn over the torso of a user. The vest body 104 is made from a durable, lightweight material to ensure comfort and ease of movement during training. The vest body includes a front side 108 and a back side 112. It is secured with adjustable fastening means 116, such as Velcro straps 120, allowing the user to adjust the vest for a snug and secure fit.

The vest features a plurality of attachment points 124 distributed across the body 104. These attachment points, which include rings and loops, are strategically positioned to allow for the selective attachment of resistance bands 128. The attachment points are positioned on the shoulders 132, sides 136, and lower back 140 of the vest body. At least one resistance band 128 is configured to be attached to the vest at the attachment points 124. The resistance bands are further attached to the user's arm via wrist straps 144, providing resistance during training exercises. The resistance bands are adjustable to provide varying levels of resistance, enhancing striking power, accuracy, and endurance.

The Striker Vest 100 further comprises at least one adjustable cross strap 148. The cross strap is positioned to secure the user's non-striking arm close to the body, thereby maintaining proper guard posture. In one embodiment, the cross strap is configured to secure the elbow in a closed position against the body. The vest includes an upper forearm pull-in strap 152, which comprises a circular loop 156 placed around the user's upper forearm. The strap includes at least two pull-in lever straps 160 for securing the upper forearm and pulling it closer to the body, thereby enhancing guard posture.

The vest also features a lower stabilizer belt 164, configured to stabilize the vest body during use. It is attached through loops on the lower back side 140 of the vest body, ensuring the vest remains securely in place during vigorous training. The wrist strap 144 includes an adjustable thumb loop 168 for securing the user's wrist. The wrist strap is designed to attach to the resistance band, providing a secure and comfortable connection during training. The vest body is dual-sided, facilitating the training of both sides of the user's body. This design ensures that the fighter can develop balanced skills, enhancing performance on both the left and right sides.

In another implementation of the present invention, a method of using the Striker Vest 100 for enhancing combat training involves the following steps:

The user first dons the vest by slipping it over their head and securing it snugly with the adjustable fastening means 116, such as Velcro straps 120. Once the vest body 104 is securely in place, the user selects the appropriate attachment points 124 on the vest body for their desired training exercise. The resistance bands 128 are then attached to the chosen rings and loops on the vest. The other end of the resistance bands is connected to the wrist straps 144, which are worn around the user's wrists. For enhanced guard posture, the adjustable cross strap 148 is positioned to secure the non-striking arm close to the body. If further stabilization is needed, the lower stabilizer belt 164 is threaded through the loops on the lower back side of the vest body and fastened. The user can then proceed with their training regimen, performing striking exercises against the resistance provided by the bands, which helps improve striking power, accuracy, and endurance.

The dual-sided design of the vest body 104 allows for balanced training of both sides of the body. The various attachment points 124 enable customization of resistance levels and training configurations to suit individual needs and preferences. The Striker Vest 100 offers several advantages over traditional training equipment. Unlike resistance bands and weighted vests that address isolated aspects of combat training, the Striker Vest provides a comprehensive solution by conditioning both the striking and guard arms simultaneously. This integrated approach ensures that fighters maintain proper posture and stance while enhancing their punching power and accuracy.

The vest's adjustable design accommodates fighters of different sizes and training needs, promoting a more personalized training experience. The incorporation of advanced materials and biomechanics principles reduces the risk of injury and enhances overall training effectiveness. By offering immediate feedback through its resistance mechanisms, the Striker Vest helps fighters develop correct techniques and habits, ultimately leading to improved performance in combat scenarios.

As illustrated in FIG. 1, the Striker Vest 100 includes a vest body 104 that is worn over the torso. The front side 108 and the back side 112 of the vest body provide coverage and support for the upper body. The neck opening 172 is designed to fit comfortably around the user's neck. The shoulder straps 132 are adjustable and provide additional support to keep the vest body in place during training.

Figure 2:
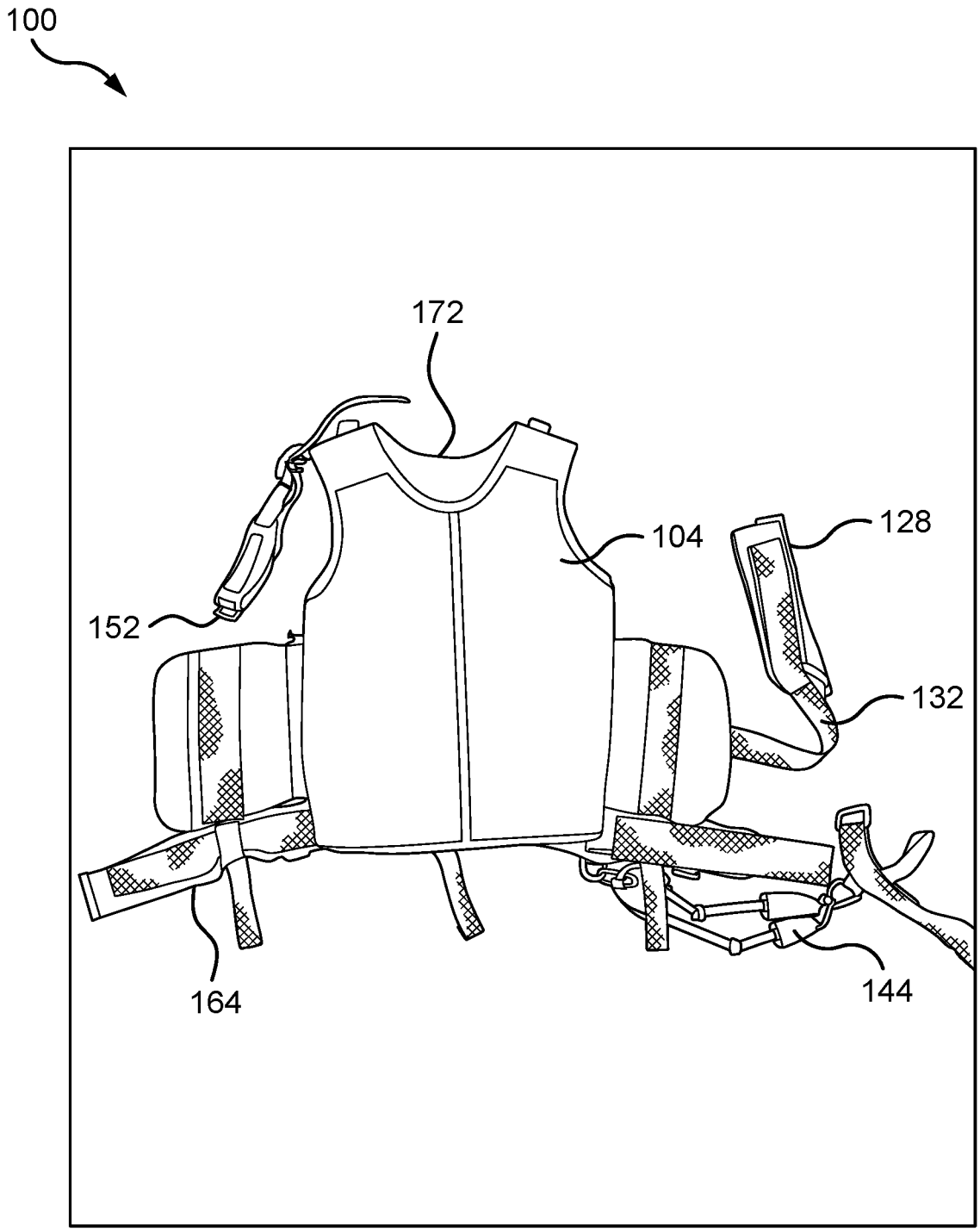
FIG. 2 presents a top view of the striker vest in a closed, illustrating various components including the vest body, the front side, the back side, the neck opening, the shoulder straps, and the lower stabilizer belt.

The lower stabilizer belt 164, shown in FIG. 2, wraps around the lower torso and stabilizes the vest body 104, ensuring it remains securely in place during movement. The upper forearm pull-in strap 152 is designed to secure the upper forearm close to the body, enhancing guard posture.

Figure 3:
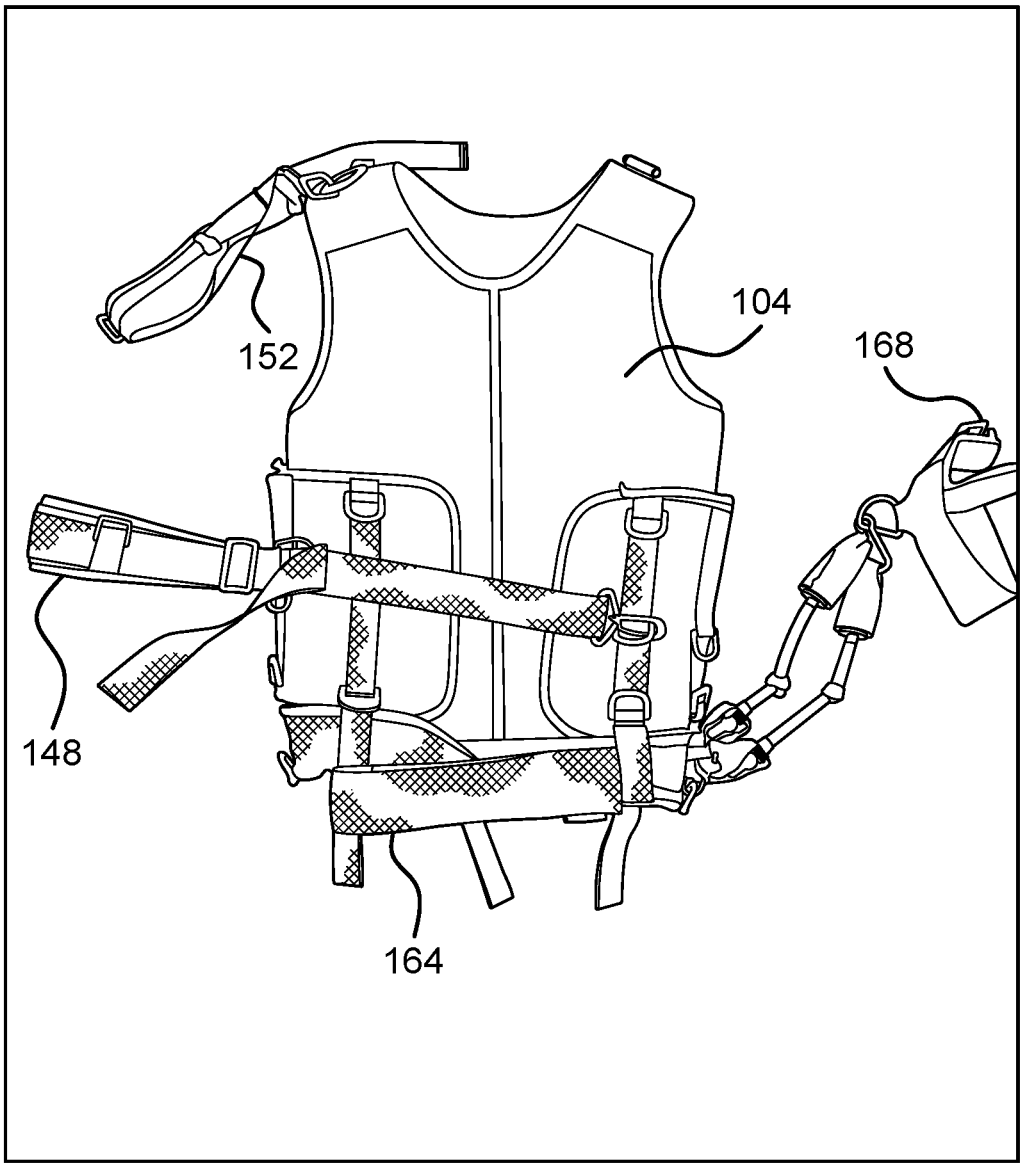
FIG. 3 presents a front view of the training vest, illustrating various components including the vest body, the front side, the back side, the shoulder straps, and the cross strap.

The cross strap 148, as shown in FIG. 3, secures the non-striking arm close to the body, maintaining proper guard posture and protecting against strikes.

Figure 4:
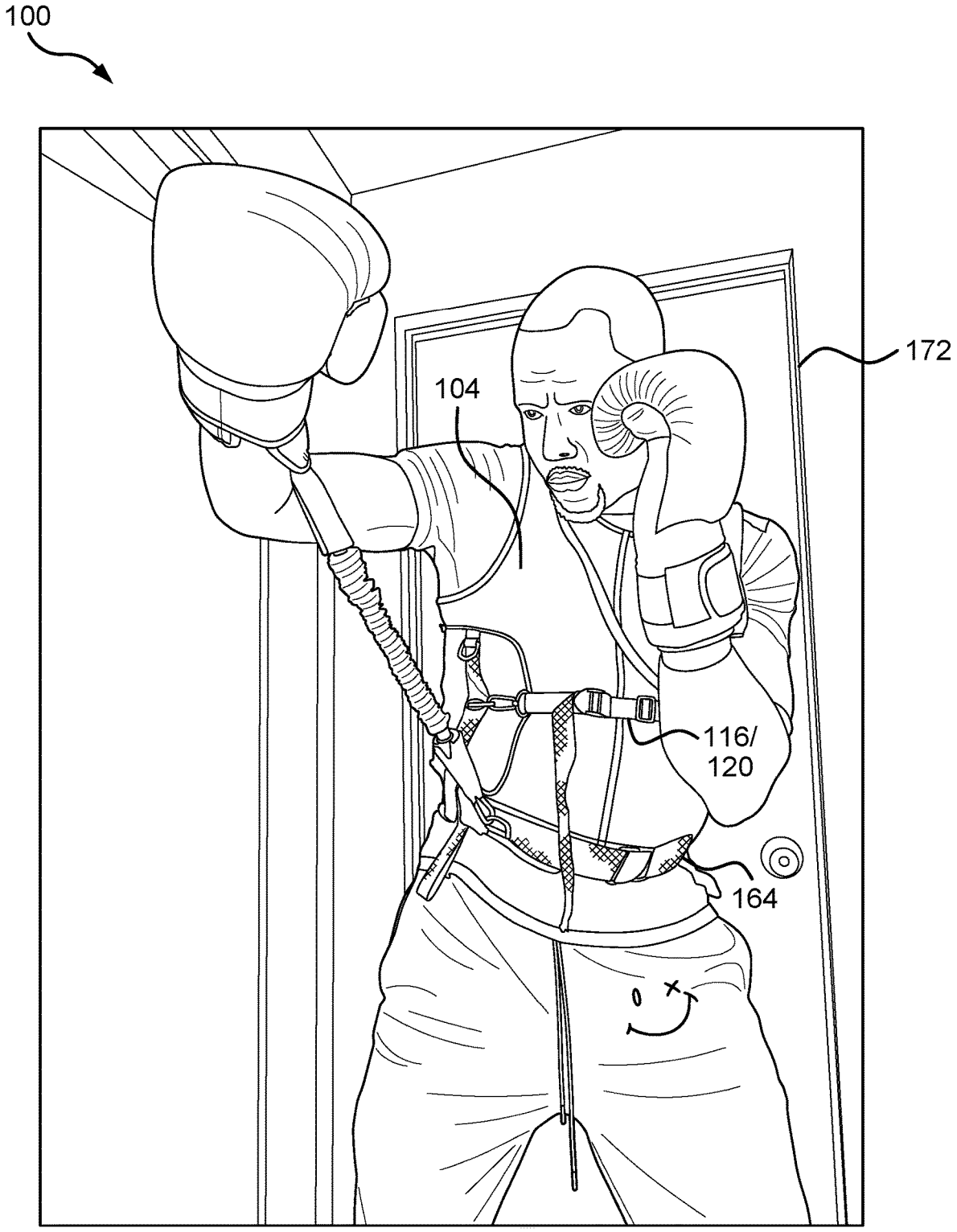
FIG. 4 presents a perspective view of the training vest being used by a fighter, illustrating the vest body worn over the torso, the resistance bands attached to the wrist straps, and the user demonstrating a striking position with proper guard posture maintained.

The resistance bands 128, depicted in FIG. 4, are attached to the wrist straps 144 and provide resistance during striking exercises. The wrist straps include adjustable thumb loops 168 to secure the user's wrists comfortably. The resistance bands are attached to the vest body at multiple attachment points, allowing for customizable resistance levels and training configurations.

The Striker Vest 100's dual-sided design, as shown throughout the figures, allows for balanced training of both sides of the body. This feature ensures that the user can develop strength and skills on both the left and right sides, leading to a more versatile and effective fighter. The vest's adjustable design accommodates users of different sizes, promoting a more personalized and effective training experience.

The attachment points 124, including rings and loops, are strategically positioned on the shoulders 132, sides 136, and lower back 140 of the vest body. These attachment points allow for the selective attachment of resistance bands 128, enabling the user to customize their training regimen according to their specific needs and preferences. The resistance bands provide varying levels of resistance, enhancing striking power, accuracy, and endurance.

The adjustable cross strap 148, positioned to secure the non-striking arm close to the body, ensures proper guard posture. This feature is important for maintaining a protective stance and reinforcing muscle memory during training. The upper forearm pull-in strap 152, with its circular loop 156 and pull-in lever straps 160, secures the upper forearm and pulls it closer to the body, further enhancing guard posture.

The lower stabilizer belt 164, attached through loops on the lower back 140 of the vest body, provides additional stability during use. This feature ensures that the vest remains securely in place, even during vigorous training sessions. The wrist strap 144, with its adjustable thumb loop 168, secures the user's wrist and attaches to the resistance band 128, providing a secure and comfortable connection.

The dual-sided design of the vest body facilitates balanced training of both sides of the body. This feature allows the user to develop strength and skills on both the left and right sides, leading to a more versatile and effective fighter. The vest's adjustable design accommodates users of different sizes, promoting a more personalized and effective training experience.

In conclusion, the Striker Vest 100 offers a comprehensive solution for enhancing a fighter's combat skills. By integrating multiple functionalities into a single, versatile training apparatus, the Striker Vest addresses the deficiencies of traditional training tools. The vest's design not only enhances striking power and accuracy but also ensures proper guard posture and stance. The customizable resistance levels and multiple attachment configurations cater to individual training needs, making the Striker Vest a valuable tool for fighters seeking to improve their combat skills comprehensively. The detailed description and figures provided illustrate the innovative features and benefits of the Striker Vest 100, highlighting its effectiveness as a training apparatus for fighters.

In another implementation of the present invention, the method of using the Striker Vest involves first donning the vest by slipping it over the head and securing it with the adjustable fastening means 116, such as Velcro straps 120. The user then selects the appropriate attachment points 124 on the vest body for their desired training exercise. The resistance bands 128 are attached to the chosen rings and loops on the vest, and the other end of the bands is connected to the wrist straps 144 worn around the user's wrists. For enhanced guard posture, the adjustable cross strap 148 is positioned to secure the non-striking arm close to the body. If further stabilization is needed, the lower stabilizer belt 164 is threaded through the loops on the lower back side of the vest body and fastened. The user then proceeds with their training regimen, performing striking exercises against the resistance provided by the bands, which helps improve striking power, accuracy, and endurance.

The Striker Vest's design allows for balanced training of both sides of the body, with various attachment points 124 enabling customization of resistance levels and training configurations to suit individual needs and preferences. The Striker Vest offers several advantages over traditional training equipment by providing a comprehensive solution that conditions both the striking and guard arms simultaneously. This integrated approach ensures that fighters maintain proper posture and stance while enhancing their punching power and accuracy. The vest's adjustable design accommodates fighters of different sizes and training needs, promoting a more personalized training experience.

The incorporation of advanced materials and biomechanics principles reduces the risk of injury and enhances overall training effectiveness. Immediate feedback through its resistance mechanisms helps fighters develop correct techniques and habits, leading to improved performance in combat scenarios.

As illustrated, the Striker Vest 100 includes a vest body that is worn over the torso, with the front side 108 and back side 112 providing coverage and support. The neck opening 172 is designed to fit comfortably around the user's neck, and the shoulder straps 132 are adjustable to provide additional support, keeping the vest body in place during training. The lower stabilizer belt 164 wraps around the lower torso, stabilizing the vest body, and ensuring it remains securely in place during movement. The upper forearm pull-in strap 152 secures the upper forearm close to the body, enhancing guard posture, while the cross strap 148 secures the non-striking arm close to the body, maintaining proper guard posture and protecting against strikes.

The resistance bands 128, attached to the wrist straps 144, provide resistance during striking exercises. The wrist straps include adjustable thumb loops 168 to secure the user's wrists comfortably. The resistance bands are attached to the vest body at multiple attachment points, allowing for customizable resistance levels and training configurations.

The Striker Vest's dual-sided design allows for balanced training of both sides of the body, ensuring that the user can develop strength and skills on both the left and right sides.

The vest's adjustable design accommodates users of different sizes, promoting a more personalized and effective training experience.

The attachment points 124, including rings and loops, are strategically positioned on the shoulders 132, sides 136, and lower back 140 of the vest body. These attachment points allow for the selective attachment of resistance bands, enabling the user to customize their training regimen according to their specific needs and preferences. The resistance bands provide varying levels of resistance, enhancing striking power, accuracy, and endurance.

The adjustable cross strap 148, positioned to secure the non-striking arm close to the body, ensures proper guard posture. This feature is important for maintaining a protective stance and reinforcing muscle memory during training. The upper forearm pull-in strap 152, with its circular loop 156 and pull-in lever straps 160, secures the upper forearm and pulls it closer to the body, further enhancing guard posture.

The lower stabilizer belt 164, attached through loops on the lower back of the vest body, provides additional stability during use. This feature ensures that the vest remains securely in place, even during vigorous training sessions. The wrist strap 144, with its adjustable thumb loop 168, secures the user's wrist and attaches to the resistance band, providing a secure and comfortable connection.

The dual-sided design of the vest body facilitates balanced training of both sides of the body. This feature allows the user to develop strength and skills on both the left and right sides, leading to a more versatile and effective fighter. The vest's adjustable design accommodates users of different sizes, promoting a more personalized and effective training experience.

The Striker Vest represents a significant advancement in combat training equipment. By integrating multiple functionalities into a single, versatile training apparatus, the Striker Vest addresses the deficiencies of traditional training tools. The vest's design not only enhances striking power and accuracy but also ensures proper guard posture and stance. The customizable resistance levels and multiple attachment configurations cater to individual training needs, making the Striker Vest a valuable tool for fighters seeking to improve their combat skills comprehensively. The detailed description and figures provided illustrate the innovative features and benefits of the Striker Vest, highlighting its effectiveness as a training apparatus for fighters.

Since many modifications, variations, and changes in detail can be made to the described preferred embodiments of the invention, it is intended that all matters in the foregoing description and shown in the accompanying drawings be interpreted as illustrative and not in a limiting sense.

Furthermore, it is understood that any of the features presented in the embodiments may be integrated into any of the other embodiments unless explicitly stated otherwise. The scope of the invention should be determined by the appended claims and their legal equivalents.

The invention claimed is:

1. A training vest for enhancing a fighter's combat skills comprising:

a vest body configured to be worn over the torso of a user and secured in place with fastening means;

a plurality of attachment points distributed on the vest body;

at least one adjustable cross strap positioned to secure the user's non-striking arm close to the user's body, thereby maintaining proper guard posture;

at least one resistance band configured to be attached to the vest body at the plurality of attachment points, and further attached to the user's arm to provide resistance during training;

wherein the vest body is configured to allow training of both sides of the user's body, and the attachment points are positioned to provide multiple configurations for different training exercises and user preferences.

2. The training vest of claim 1, further comprising an upper forearm pull-in strap comprising a circular loop placed around the user's upper forearm.

3. The training vest of claim 2, wherein the upper forearm pull-in strap includes at least two pull-in lever straps for securing the upper forearm and pulling it closer to the user's body.

4. The training vest of claim 1, further comprising a lower stabilizer belt configured to stabilize the training vest during use.

5. The training vest of claim 4, wherein the lower stabilizer belt is attached through loops on a lower back side of the vest body.

6. The training vest of claim 1, further comprising a wrist strap with an adjustable thumb loop for securing the user's wrist.

7. The training vest of claim 6, wherein the wrist strap is configured to attach to a resistance band.

8. The training vest of claim 1, wherein the resistance band is adjustable to provide varying levels of resistance.

9. The training vest of claim 8, wherein the resistance band is attached to the vest body at multiple attachment points.

10. The training vest of claim 1, wherein the vest body is dual-sided to allow training of both sides of the user's body.

11. The training vest of claim 10, wherein the plurality of attachment points are positioned to provide multiple configurations for different training exercises.

12. The training vest of claim 1, wherein the fastening means comprise Velcro straps.

13. The training vest of claim 1, wherein the cross strap is configured to secure a elbow in a closed position against the user's body.

14. The training vest of claim 1, further comprising Velcro flaps on both sides of the vest body for securing the vest.

15. The training vest of claim 1, wherein the vest body is made from a durable, lightweight material to ensure comfort and ease of movement during training.

16. A method of using a training vest for enhancing combat skills, comprising:

donning the training vest by slipping it over the head and securing it with adjustable fastening means;

selecting appropriate attachment points on the vest body for the desired training exercise;

attaching resistance bands to the selected attachment points on the vest body, and connecting the other end of the bands to wrist straps worn around the user's wrists;

positioning an adjustable cross strap to secure the non-striking arm close to a body of the user for enhanced guard posture;

threading a lower stabilizer belt through loops on a lower back side of the vest body and fastening it for additional stabilization if needed;

performing striking exercises against the resistance provided by the bands to improve striking power, accuracy, and endurance.

17. A training vest for enhancing a fighter's combat skills comprising:

a vest body configured to be worn over the torso of a user and secured in place with adjustable fastening means;

at least one adjustable cross strap positioned to secure the user's non-striking arm close to a body of the user, thereby maintaining proper guard posture;

a plurality of rings and attachment points distributed on the vest body, positioned to allow selective attachment of resistance bands and straps;

at least one resistance band configured to be attached to the vest body at the plurality of rings and attachment points, and further attached to the user's striking arm via a wrist strap, providing customizable resistance to improve striking power, accuracy, and endurance;

an upper forearm pull-in strap comprising a circular loop placed around the user's upper forearm, the strap having at least two pull-in lever straps for securing the upper forearm and pulling it closer to the body of the user, thereby enhancing guard posture;

a lower stabilizer belt configured to stabilize the vest during use, attached through loops on a lower back side of the vest body; and a wrist strap with an adjustable thumb loop for securing the user's wrist and attaching the resistance band;

wherein the vest body is dual-sided to allow training of both sides of the user's body, and the rings and attachment points are positioned to provide multiple configurations for different training exercises and user preferences.

* * * * *